US006886300B2

(12) United States Patent
Hudoba et al.

(10) Patent No.: US 6,886,300 B2
(45) Date of Patent: May 3, 2005

(54) TENSIONED FABRIC STORM PROTECTION PANEL

(75) Inventors: Mark Steven Hudoba, Gulf Breeze, FL (US); Harry Edward Asbury, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 24 days.

(21) Appl. No.: 10/225,550

(22) Filed: Aug. 22, 2002

(65) Prior Publication Data

US 2004/0035082 A1 Feb. 26, 2004

(51) Int. Cl.[7] ..... E04B 1/00

(52) U.S. Cl. ..... 52/222; 52/3; 52/656.6; 52/656.9; 160/381; 160/371; 160/372; 135/115; 135/119

(58) Field of Search ..... 52/3, 222, 656.9, 52/656.6; 135/115, 119; 160/371, 372, 381

(56) References Cited

U.S. PATENT DOCUMENTS

| | | | | |
|---|---|---|---|---|
| 2,808,880 A | | 10/1957 | Frick | |
| 3,709,533 A | * | 1/1973 | Waltters | 287/189.36 |
| 4,195,681 A | * | 4/1980 | Douglas et al. | 160/371 |
| 4,570,406 A | * | 2/1986 | Difazio | 52/656 |
| 5,431,211 A | * | 7/1995 | Guillemet | 160/381 |
| 5,450,701 A | * | 9/1995 | White | 52/656.9 |
| 5,457,921 A | | 10/1995 | Kostrzecha | |
| 5,485,705 A | * | 1/1996 | Guillemet | 52/656.9 |
| 5,560,149 A | | 10/1996 | Lafevre | |
| 5,579,794 A | | 12/1996 | Sporta | |
| 5,701,813 A | * | 12/1997 | Smith | 160/180 |
| 5,918,430 A | | 7/1999 | Rowland | |
| 6,176,050 B1 | | 1/2001 | Gower | |
| 6,257,305 B1 | | 7/2001 | Mullet et al. | |
| 6,296,039 B1 | | 10/2001 | Mullet et al. | |

FOREIGN PATENT DOCUMENTS

WO WO 02 12672 A 2/2002

* cited by examiner

*Primary Examiner*—Carl D. Friedman
*Assistant Examiner*—Yvonne M. Horton
(74) *Attorney, Agent, or Firm*—Renner, Kenner, Greive, Bobak, Taylor & Weber

(57) ABSTRACT

A panel (10) for protecting a portion of a structure such as a window (11) includes a frame member (13) made up of four channel members (16–19) interconnected by corner members (20). One end of each channel member (16–19) includes an opening to receive an edge of a sheet (33) of flexible material. The sheet (33) is provided with a thickened area (34) near each edge thereof. A fabric locking and stretching member (15) closes the opening in each channel member (16–19) and engages the thickened area (34) of the fabric sheet (33) to stretch the sheet (33) within the frame member (13).

20 Claims, 6 Drawing Sheets

TENSIONED FABRIC STORM PROTECTION PANEL

TECHNICAL FIELD

This invention relates to a device for protecting property by covering and sealing the openings in a structure, such as windows or other openings, from the damage which could be caused by water and air infiltration or the deterioration of the structure due to the structure's envelope being breached by impacts from debris or other objects which might be airborne because of such winds. More particularly, this invention relates to such a device which is in the form of a panel so as to be easily installed, and which is formed of a tensioned fabric material.

BACKGROUND ART

Extreme weather-created phenomenon, such as hurricanes, typhoons, tornadoes, or the like can often cause damage to building structures. Such storm-related damage frequently occurs when high winds and/or debris carried thereby breaks windows or doors which, of course, makes the structure vulnerable to further damage to the interior thereof. Thus, particularly in geographic areas susceptible to frequent violent weather conditions, it is important to protect the weakest portions of a structure, usually the windows and the doors, with some type of covering.

Most traditionally, home or building owners, if alerted to an oncoming storm, cover the weakest portions of their structures by nailing boards over these portions. However, this "boarding up" procedure is not only time consuming, when time is usually of the essence, but also can disfigure the exterior of the structure upon the frequent installation and removal of the boards. Moreover, storing or maintaining an inventory of the boards can take up a great deal of space which would otherwise be usable for other projects.

As a result, a number of temporarily installable or permanently installed shutters have been developed. However, in general, these devices are expensive, difficult to install or disassemble, and cumbersome to store. For example, some of these shutters consist of rolled-up corrugated material which must be rolled down, either manually or automatically by a motor, and as such, are quite costly. Alternatively, metallic panels such as those made out of aluminum or steel, may be specially designed for each structure opening to be protected, and mounted to the wall of the structure on a special frame. At times, a LEXAN® type of material has been substituted for the metallic portion of the device. However, all of these alternatives are quite expensive, are not aesthetically pleasing, and, particularly in the case of the LEXAN® material, do not weather well.

Other alternatives to these shutter-like devices are fabric-based systems. These systems, while less expensive than their counterparts, are quite large, cumbersome, and difficult to install. Usually, they are attached to an overhang or an eave and must be positioned at a distance in excess of two feet, from the window or door to be protected. They must be specially designed for each such item to be covered, dependent on the nature of the item and its location relative to an overhang or an eave, and they are usually quite large, presenting installation and storage issues The need exists, therefore, for a system which will not be plagued by these problems of the prior art.

DISCLOSURE OF THE INVENTION

It is thus an object of the present invention to provide a panel for covering an opening, such as a window or a door, of a building structure.

It is another object of the present invention to provide a panel, as above, which is lightweight having a flexible fabric material covering the opening in the structure.

It is a further object of the present invention to provide a panel, as above, which is easily and quickly assembled, and when so assembled, the fabric is automatically tensioned to protect the portion of the structure being covered.

It is an additional object of the present invention to provide a panel, as above, which is easy to install, being quickly mountable to the wall surrounding the opening in the structure.

It is yet another object of the present invention to provide a panel, as above, which when installed over an opening provides a good seal while at the same time providing an aesthetically appealing appearance.

It is a still further object of the present invention to provide a panel, as above, which is easily and conveniently storable when not in use.

These and other objects of the present invention, as well as the advantages thereof over existing prior art forms, which will become apparent from the description to follow, are accomplished by the improvements hereinafter described and claimed.

In general, a panel which is adapted to be attached to a structure includes at least one pair of opposed channel members, each having an opening therein. A sheet of flexible material is provided with a thickened area near at least two opposed edges, each opposed edge being received in the opening in each channel member. Means are provided to engage each channel member and engage the thickened areas of the flexible material to stretch the flexible material and maintain the edge in each channel member.

In accordance with another aspect of the present invention, the panel includes four channel members each having an end connected to the end of an adjacent panel member to form a frame. Each channel member has an opening therein to receive an edge of a sheet of flexible material which has a thickened area formed near each edge. A fabric locking and stretching member is provided for each channel member to close the openings in the channel members and to stretch the flexible material.

A preferred exemplary panel for protecting an opening in a building structure incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
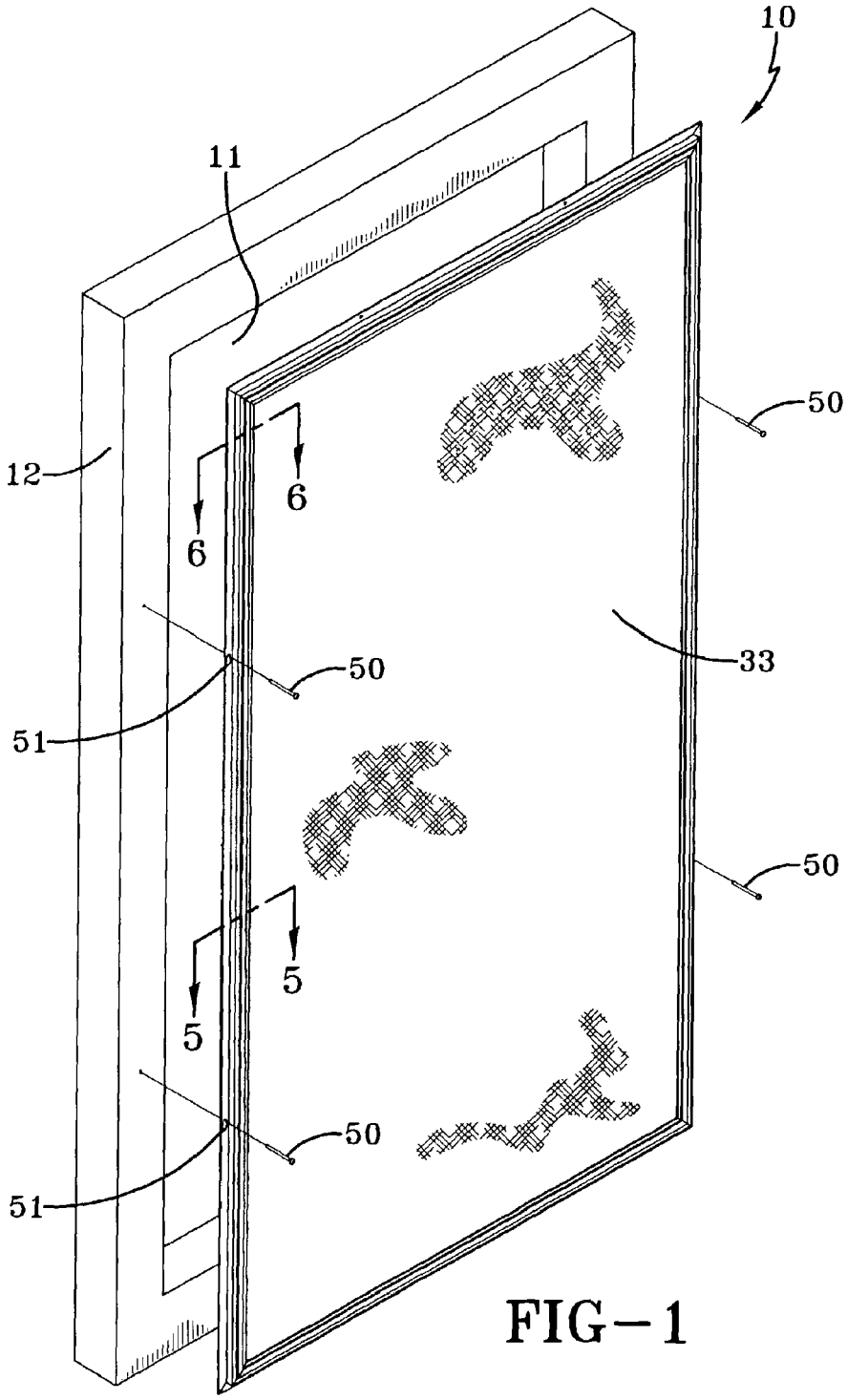
FIG. 1 is a perspective view showing a panel made in accordance with the concepts of the present invention and the manner in which it may be received over a window of a structure.
Figure 2:
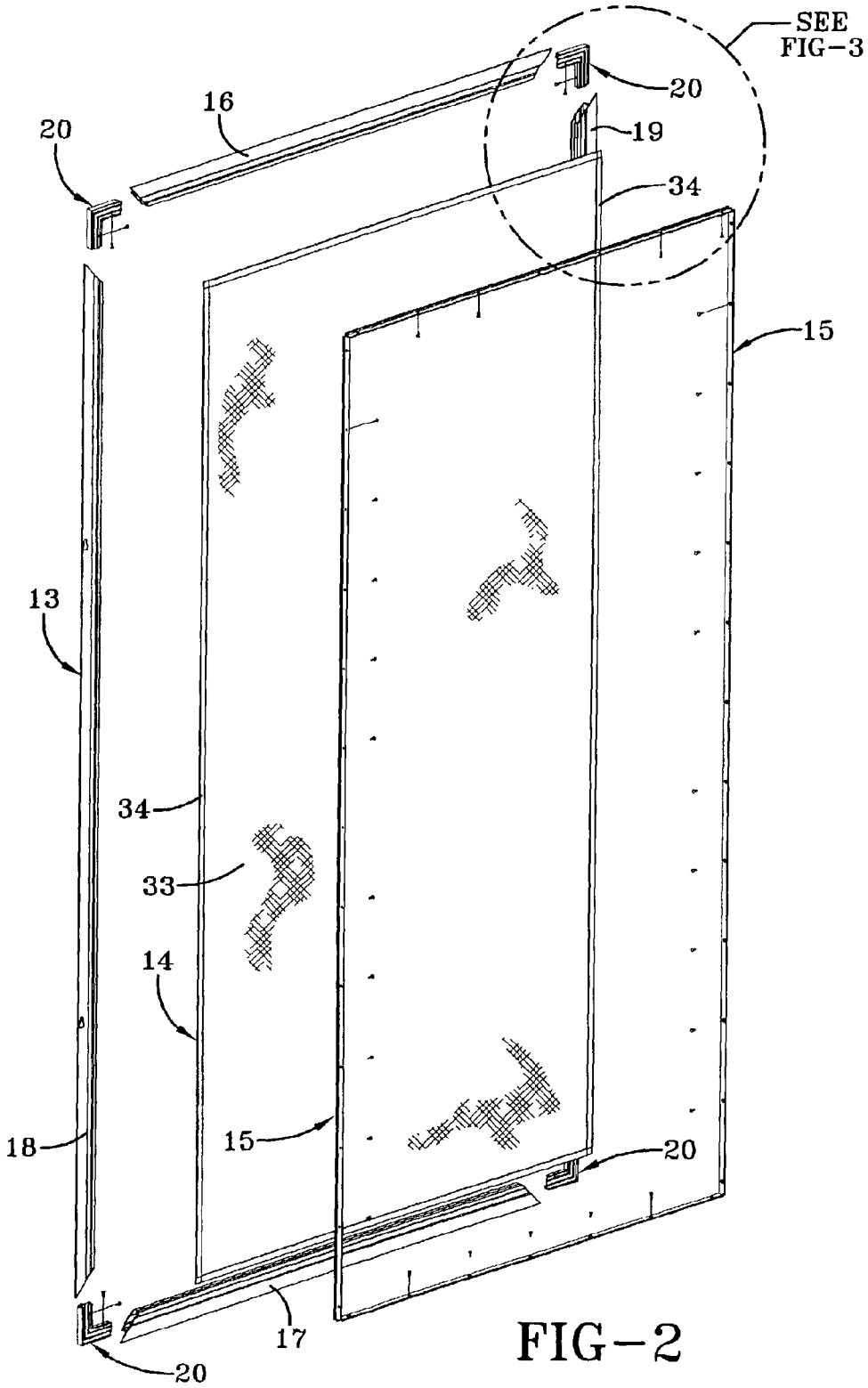
FIG. 2 is an exploded perspective view showing the major components of the panel shown in FIG. 1.

A storm protection panel made in accordance with the present invention is indicated generally by the numeral 10 and shown in FIG. 1 as being attachable over a window 11 of a structure, the window having a frame 12. Panel 10 is made up of three primary components—a frame member generally indicated by the numeral 13, a flexible material generally indicated by the numeral 14, and four fabric locking and stretching members 15. Locking and stretching members 15 are preferably separate elements but for convenience purposes are shown in the shape of a frame which is the shape that members 15 together take on when assembled in panel 10.

Frame member 13 includes opposed top and bottom channels 16 and 17, and opposed side channels 18 and 19. Channels 16–19 are preferably made out of a metallic material such as aluminum or steel and are generally identically configured. Channels 16–19 are interconnected at their adjacent ends by corner members generally indicated by the numeral 20. Thus, a corner member 20 connects side channel 18 to top channel 16, a corner member 20 connects top channel 16 to side channel 19, a corner member 20 connects side channel 19 to bottom channel 17, and a corner member 20 connects bottom channel 17 to side channel 18.

Each channel 16, 17, 18 and 19 includes a mounting flange 21 integrally formed with opposed, spaced walls 22, 23 that are interconnected by a side wall 24. Walls 22, 23 may be provided with raised/depressed areas 25 which not only add some strength to the channels 16–19, but which also provide somewhat of a decorative surface for panel 10 and render channels 16–19 readily stackable in a smaller space. A lip 26 extends from wall 22 toward wall 23, but does not extend all the way to wall 23, thereby providing channels 16–19 with a partially open end opposite to side wall 24.

Figure 3:
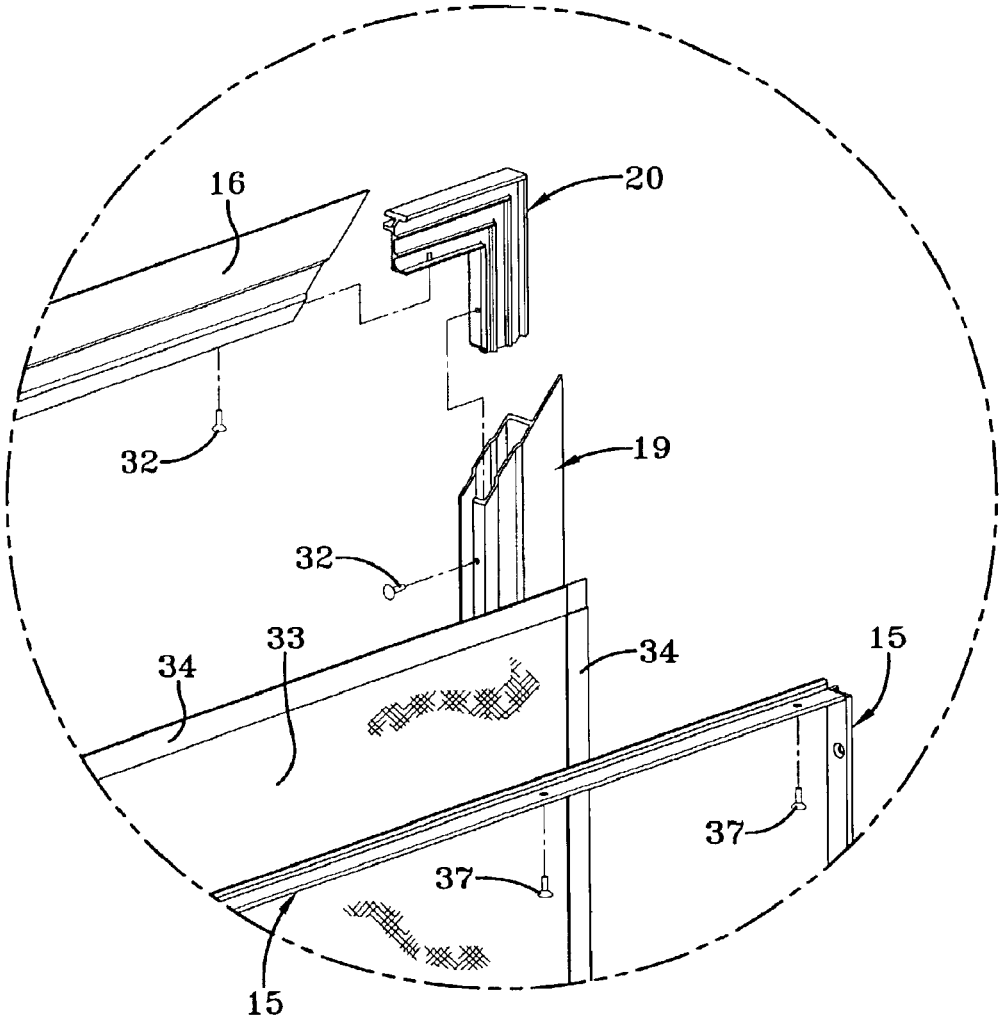
FIG. 3 is an enlarged view of the portion of the exploded panel encircled in FIG. 2.
Figure 6:
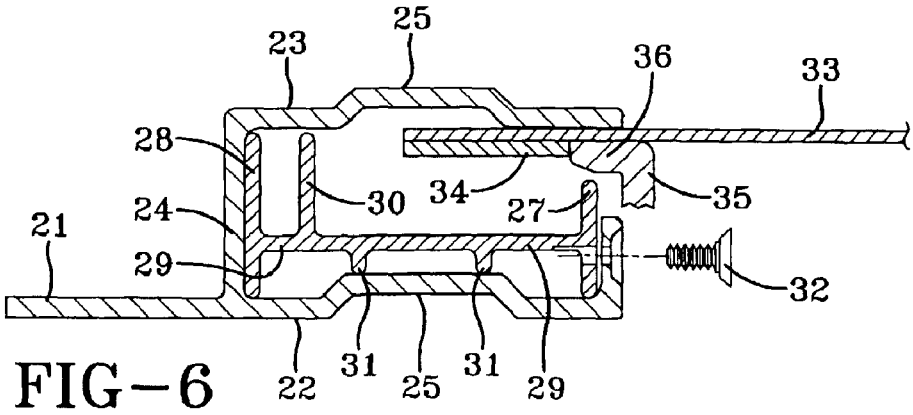
FIG. 6 is a fragmentary sectional view taken substantially along line 6—6 of FIG. 1 showing the embodiment depicted in FIG. 5A.

The profile of each corner member 20 and the manner it is received within channels 16–19 is best shown in FIGS. 3 and 6. Each corner member has branches which include an inner wall 27 separated from an outer wall 28 by a plate 29. A rib 30 may extend from plate 29 near wall 28 to add stability to corner member 20, and locator feet 31 may also be provided to rest against one raised/depressed area 25. Each branch of a corner member 20 can be attached to a channel as by screws 32 received through lip 26 and inner wall 27.

The flexible material 14 preferably includes a fabric sheet 33 having a thickened area 34 at its perimeter. The fabric 33 can be of any sturdy, preferably lightweight, material which is weather resistant and which, when tensioned, can withstand the forces generated by high winds or flying debris. For example, a vinyl- or urethane-coated nylon or polyester fabric would be suitable for flexible material 14. The thickened area 34 at the edges of fabric sheet 33 may be formed by any convenient method. For example, a separate strip of material could be sewn, glued, welded, or the like along the perimeter of fabric sheet 33. Or, alternatively, the edges of sheet 33 could be folded over and sewn to form an area 34 of double thickness or more along the edges of sheet 33.

Figure 4:
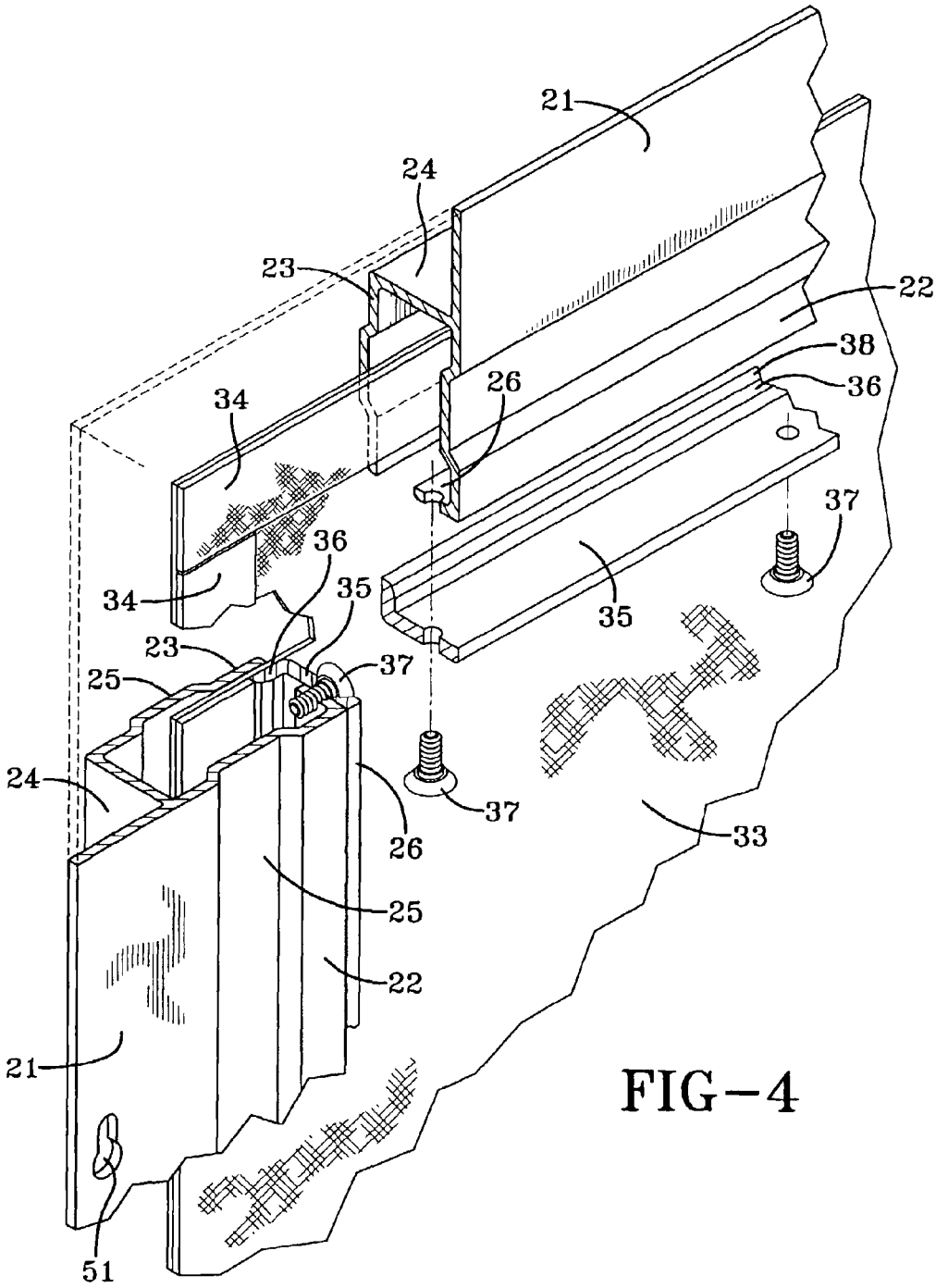
FIG. 4 is a fragmentary perspective view showing exploded portions of some of the components of the panel of FIG. 1.
Figure 5A:
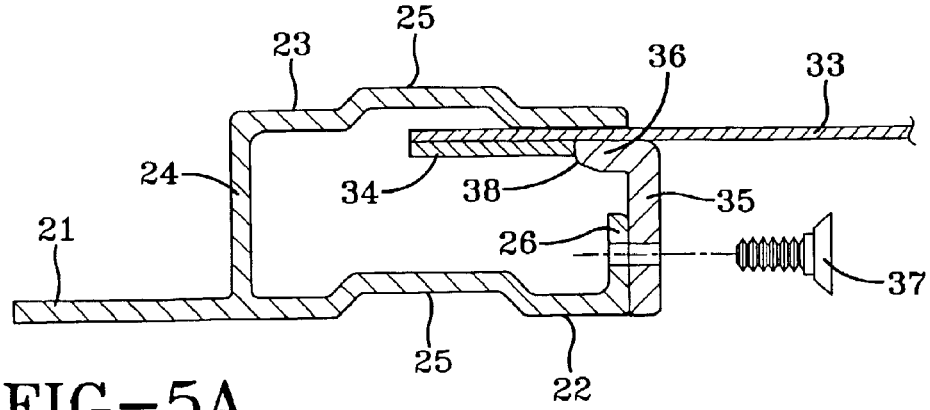
FIG. 5A is a sectional view taken substantially along line 5—5 of FIG. 1 showing one embodiment of a panel of the present invention.

Panel 10 is assembled by first positioning the edges of fabric sheet 33 through the open ends of channels 16–19 and, therefore, into the space between walls 22 and 23. The locking and stretching member 15 is then used to stretch fabric sheet 33, to maintain it within channels 16–19, and to close the opening in the channels 16–19. One form of a member 15 is best shown in FIGS. 4 and 5A. There an L-shaped member, which is preferably made of a metallic material such as aluminum or steel, is shown as including a mounting plate 35 and a flange 36 extending angularly therefrom at approximately a right angle. One member 15 is attached to each channel 16, 17, 18 and 19 by suitable fasteners, such as screws 37, which extend through plate 35 and into lip 26 of channels 16–19. As the screws 37 are being tightened, the edge 38 of flange 36 bears against the thickened area 34 of fabric sheet 33 to stretch the flexible material taught. The degree of the tightening of screws 37 thus controls the tension on the fabric. This stretching can be accomplished in at least one direction, that is, either between top and bottom channels 16 and 17 or between side channels 18 and 19, but preferably the material is stretched in both directions by the proper application of four locking and stretching members 15. When so assembled, members 15 not only maintain the material taught, but also they hold the material within the channels 16–19 with the sheet 33 being positioned between flange 36 and wall 23.

Figure 5B:
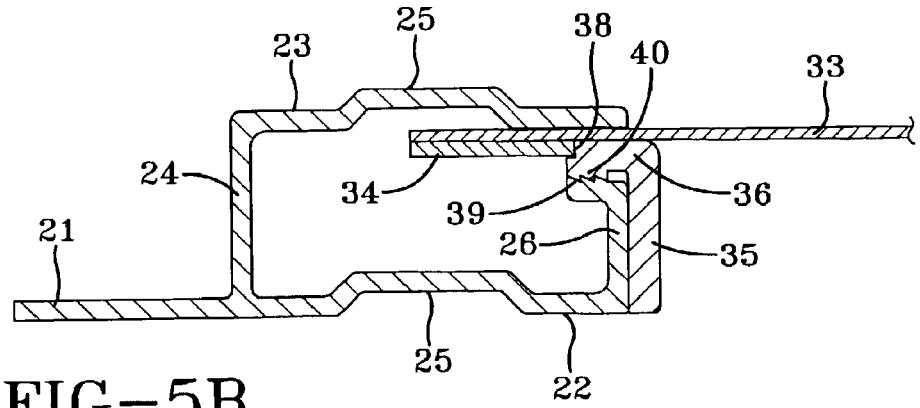
FIG. 5B is a sectional view taken substantially along line 5—5 of FIG. 1 showing another embodiment of a panel of the present invention.

An alternative form of a member 15 and its attachment to channels 16–19 is shown in FIG. 5B. In this embodiment, a toothed segment 39 is formed on top of lip 26 of each channel 16, 17, 18 and 19, and mating teeth 40 are formed on flange 36. The member 15 is merely pushed into the open space in channels 16–19, between toothed segment 39 and wall 23, and teeth 40 will engage teeth 39 to hold the fabric sheet 33 in place. It should also be evident that this embodiment also provides adjustable tensioning of the fabric sheet because edge 38 of flange 36 will engage the thickened area 34 of the fabric sheet with a varying degree of force dependent on how far member 15 is pushed into channels 16–19, that is, dependent on how many teeth of segment 39 are being engaged by the teeth 40.

Figure 5C:
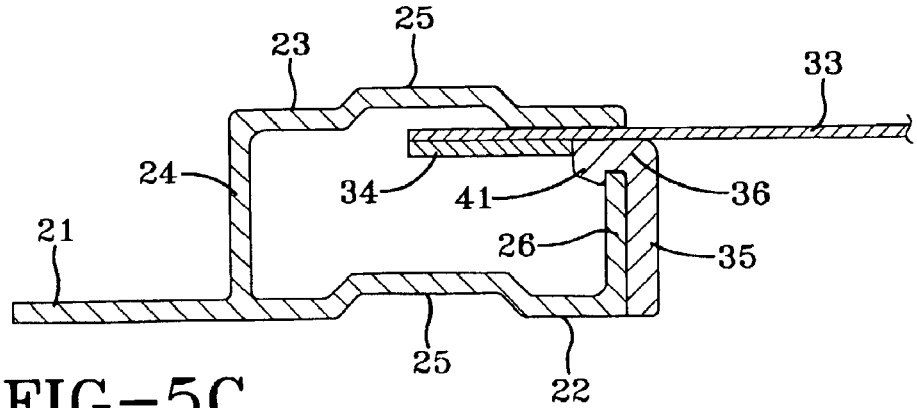
FIG. 5C is a sectional view taken substantially along line 5—5 of FIG. 1 showing another embodiment of a panel of the present invention.

Another embodiment in accordance with the present invention is shown in FIG. 5C. In this embodiment, a lock barb 41 is formed on flange 36. As member 15, is pushed in, that is, as the edge 38 of flange 36 pushes against thickened area 34 of the fabric sheet 33, the fabric will be tensioned until barb 41 snaps over the end of lip 26, as shown. This embodiment requires more precision in the manufacturing of the fabric sheet 33 because no means by which to adjust the tension is provided.

Figure 5D:
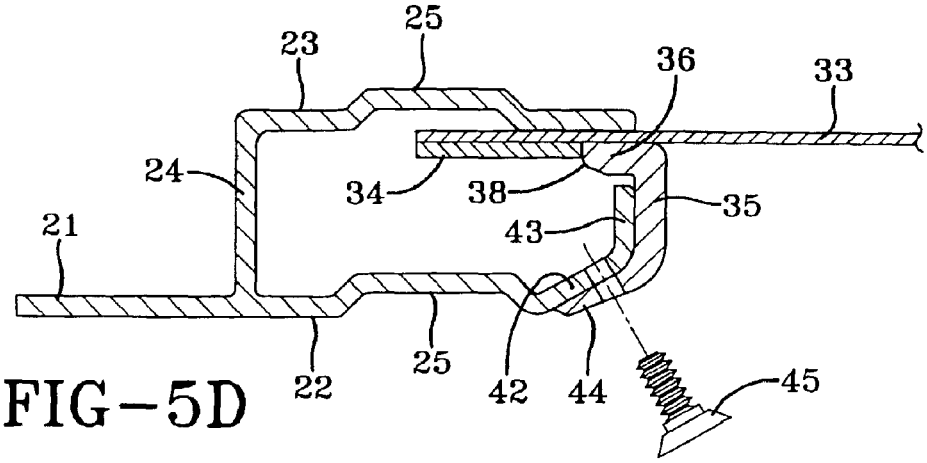
FIG. 5D is a sectional view taken substantially along line 5—5 of FIG. 1 showing another embodiment of a panel of the present invention.

In the embodiment shown in FIG. 5D, wall 22 of each channel 16, 17, 18 and 19 has a portion 42 extending angularly toward wall 23. Portion 42 terminates as a wall portion 43 extending upwardly towards wall 23 at generally a right angle. Similarly, in this embodiment, the plate 35 of the locking and stretching member 15 has an angled portion 44 complimenting portion 42 of channels 16–19. A fastener, such as screw 45, extends through portion 44 and into portion 42. As screw 45 is tightened, member 15 moves up and in to adjustably tension the fabric sheet 33 by the action of edge 38 of flange 36 on the thickened area 34 of the fabric sheet 33.

Figure 5E:
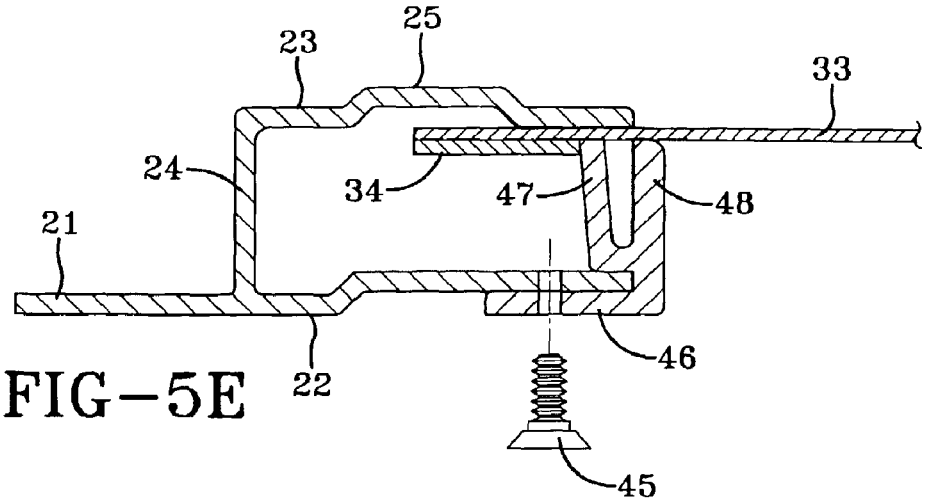
FIG. 5E is a sectional view taken substantially along line 5—5 of FIG. 1 showing another embodiment of a panel of the present invention.

FIG. 5E depicts yet another embodiment of the present invention. In this embodiment, no lip 26 is provided in channels 16–19, and the locking and stretching member 15 includes a base 46 which has a Y-shaped element, including spaced flanges 47 and 48, extending upwardly therefrom. A space between the bottom of flange 47 and base 46 receives the end of wall 22 of each channel 16, 17, 18 and 19. Member 15 is held in place by a suitable fastener, such as screw 49, received through base 46 and into wall 22. The end of flange 47 provides the stretching force on fabric sheet 33 as it engages thickened area 34. This creates a spring-like tension as flange 47 is permitted to move toward and away from flange 48. Not only does such provide an adjustable force feature, but also member 15 assists the fabric sheet 33 in absorbing the force of high winds or impacting debris. That is, when a force is applied on sheet 33, members 15 act as shock absorbers in view of the ability of flange 47 to move toward flange 48.

In all of the embodiments, when panel 10 is assembled, it can easily be mounted to the frame 12 of window 11, or to any portion of a structure which needs protection. In this regard, as shown in FIG. 1, fasteners 50 may be received through apertures 51 in the mounting flanges 21 of channels 16–19 and inserted into frame 12. Alternatively, the window frame 12 could be provided with studs or the like, and the panel 10 hung on those studs via apertures 51.

It should thus be evident that a panel constructed in accordance with any of the embodiments disclosed herein accomplishes the objects of the present invention and otherwise substantially improves the art.

What is claimed is:

1. A panel adapted to be attached to a structure comprising at least one pair of opposed channel members, each of said channel members having an opening therein, a sheet of flexible material having a thickened area near at least two opposed edges, an opposed edge being received in said opening in each of said channel members, and means engaging said channel member and engaging the edge of said thickened area to move said thickened area outwardly to stretch said fabric material and maintain each said edge of said sheet in one of said channel members.

2. The panel according to claim 1 wherein each said channel member includes a lip to be engaged by said means.

3. The panel according to claim 2 wherein said means includes a plate to close said opening and a flange carried by said plate to engage said edge of said thickened area.

4. The panel according to claim 3 wherein said means includes means to attach said plate to said lip.

5. The panel according to claim 4 wherein said plate includes an angled portion and said lip includes an angled portion, said plate being attached to said lip at said angled portions.

6. The panel according to claim 4 wherein said means to attach is a fastener.

7. The panel according to claim 4 wherein said means to attach includes teeth on said lip and mating teeth on said flange.

8. The panel according to claim 4 wherein said means to attach includes a barb on said flange to engage said lip.

9. The panel according to claim 1 wherein there are two pairs of opposed channel members and further comprising corner members to connect adjacent channel members to form a frame.

10. The panel according to claim 9 wherein each said corner member has a branch received within adjacent channel members, and further comprising means to attach each branch to a said channel member.

11. The panel according to claim 10 wherein each said channel member includes a lip and each said branch of a said corner member includes a wall, said lip being fastened to said wall.

12. The panel according to claim 1 wherein each said channel member includes a mounting flange adapted to be connected to the structure.

13. The panel according to claim 12 wherein each said channel member includes a first wall carried by said mounting flange, a second wall spaced from said first wall, and a side wall connecting said first and second walls and closing said channel member opposite to said opening.

14. The panel according to claim 1 wherein said means includes a base to engage said channel member, and spaced flanges carried by said base, one of said flanges engaging said edge of said thickened area.

15. The panel according to claim 14 wherein said one of said flanges can move toward the other of said flanges as said one of said flanges is engaging said edge of said thickened area or as said flexible material is impacted.

16. The panel according to claim 1 wherein each said channel member includes a lip, and said means includes a plate attached to said lip and a flange carried by said plate, said flange engaging said edge of said thickened area.

17. A panel adapted to be attached to a structure comprising at least one pair of opposed channel members, each of said channel members having an opening therein, and including a lip having teeth, a sheet of flexible material having a thickened area near at least two opposed edges, an opposed edge being received in said opening in each of said channel members, and a member engaging said channel member and including a flange having teeth adapted to engage said teeth of said lip, said flange engaging the edge of said thickened area to stretch said fabric material and maintain each said edge in one of said channel members.

18. A panel adapted to be attached to a structure comprising at least one pair of opposed channel members, each of said channel members having an opening therein and including a lip, a sheet of flexible material having a thickened area near at least two opposed edges, an opposed edge being received in said opening in each of said channel members, and a member engaging said channel member and including a flange having a barb to engage said lip, said flange engaging the edge of said thickened area to stretch said fabric material and maintain each said edge in one of said channel members.

19. A panel adapted to be attached to a structure comprising at least one pair of opposed channel members, each of said channel members having an opening therein, and including a lip having an angled portion and a wall portion, a sheet of flexible material having a thickened area near at least two opposed edges, an opposed edge being received in said opening in each of said channel members, and member engaging said channel member and including a plate having an angled portion and adapted to be attached to said angled portion of said lip, said member engaging said thickened area to stretch said fabric material and maintain each said edge in one of said channel members.

20. A panel adapted to be attached to a structure comprising four channel members each having an end connected to the end of an adjacent channel member to form a frame, an opening in each channel member, a sheet of flexible material having a thickened area formed near each edge thereof, an edge of said material being received in each of said channel members through said opening therein, and a fabric locking and stretching member for each of said channel members, said locking and stretching members closing said openings in said channel members and engaging the edge of said thickened area to move said thickened area outwardly to stretch said flexible material.

* * * * *